United States Patent [19]

Kageyama et al.

[11] 3,947,133

[45] Mar. 30, 1976

[54] AUTOMATIC PENCIL

[76] Inventors: Hidehira Kageyama, No. 234, 4-1-3, Ooshima, Koto, Tokyo; Takahiko Suzuki, 22-2, Yatsushima-cho, Aza, Ishida, Ooaza, Kawagoe, Saitama, both of Japan

[22] Filed: Apr. 10, 1975

[21] Appl. No.: 566,834

[30] Foreign Application Priority Data

Apr. 25, 1974 Japan ..... 49-47319[U]

[52] U.S. Cl. ..... 401/54; 401/65; 401/94

[51] Int. Cl... B43k 21/02; B43k 21/16; B43k 21/22

[58] Field of Search ..... 401/65, 67, 92, 214, 85, 401/53, 54

[56] References Cited

UNITED STATES PATENTS

| | | | |
|---|---|---|---|
| 1,737,862 | 12/1929 | Morris | 401/54 X |
| 2,488,179 | 11/1949 | Engel | 401/54 |
| 2,865,330 | 12/1958 | Swank | 401/53 |
| 3,724,960 | 4/1973 | Hashimoto | 401/67 |
| 3,804,536 | 4/1974 | Torii et al. | 401/65 |

*Primary Examiner*—Lawrence Charles
*Attorney, Agent, or Firm*—Sherman & Shalloway

[57] ABSTRACT

A push-button type automatic pencil includes an outer tubular member which is held in the hand of the user and lead rod holding means for holding the lead rod. A lead rod stepping means of a push button type is provided and the lead rod holding means is mounted within the outer member in such a way that the lead rod holding means is movable relative to the outer member, while still holding the lead rod, when the lead rod is pushed backward relative to the outer member. Accordingly, the breaking of the lead rod while writing is eliminated, and a soft writing feel is achieved.

6 Claims, 6 Drawing Figures

AUTOMATIC PENCIL

FIELD OF THE INVENTION

This invention relates to push-button type automatic pencils, and more particularly, to a lead propelling arrangement in which a lead piece or rod is moved forward every time a push-button disposed at the rear end of the body is pushed.

SUMMARY OF THE INVENTION

It is a primary object of this invention to provide an improved automatic pencil which tends to prevent the lead rod from being broken when writing.

With the automatic pencil, according to this invention, a lead holding means is movable relative to a holder or outer tubular member in the axial direction, and is biased forward with a predetermined force. Accordingly, when the outer member is pressed toward the surface of a paper sheet, the lead rod and means for holding it are allowed to move backward relative to the outer member. Consequently, the lead rod is not subjected to a larger force than the predetermined value, thereby preventing effectively breaking of the lead rod.

Another object of this invention is to provide a lead propelling mechanism, in which the movement of the lead holding means is accurately accomplished.

A further object of this invention is to provide a propelling mechanism which results in a soft feeling, when writing due to resilient movement of the lead.

Other objects and features of this invention will be apparent from the following description, with reference to the accompanying drawings, in which:

IN THE DRAWINGS

FIG. 1 is a longitudinal, partly cutaway, sectional view of a propelling mechanism embodying features of the invention; and FIGS. 2 to 6 are partial sectional views showing the different embodiments of propelling mechanisms, according to this invention.

DETAILED DESCRIPTION OF THE INVENTION

Figure 1:
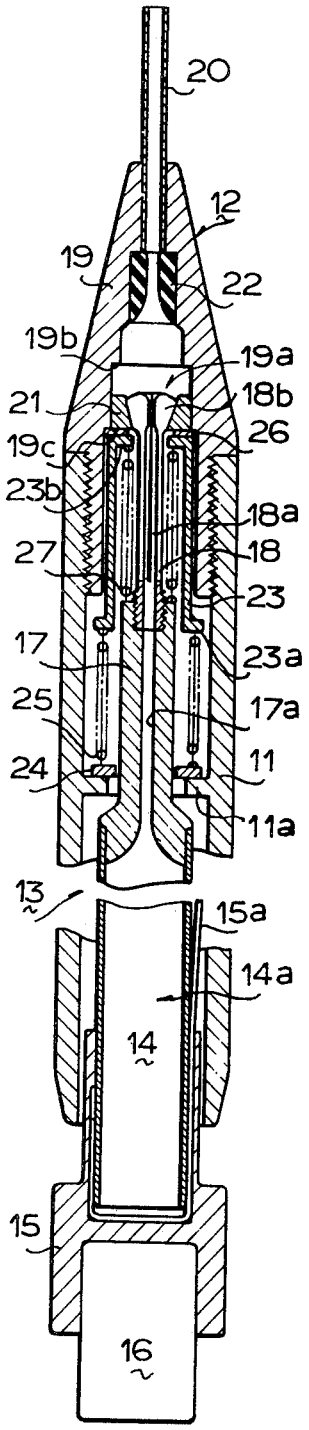

Referring to the accompanying drawings, more particularly to FIG. 1, the reference numeral 11 generally designates a holder or outer tubular member having an annular projection 11*a* on the inner surface thereof. The holder is formed of a metal or plastic material, and on the front end there is detachably mounted a guide means 12. In addition, the tubular member encloses a lead holding means 13 in the interior thereof.

The lead holding means 13 includes a tubular member or housing 14 forming a chamber 14*a* for storing one or more lead rods or pieces. A cap 15 is attached to the rear end of the housing 14, and has an eraser member 16 extending outwardly from the rear end thereof. The eraser, in effect, forms a push-button. Preferably, a resilient wire member or spring 15*a* is provided, which has a pair of portions acting to resiliently engage the end of the housing 14, so as to prevent the cap 15 from slipping off. One of the portions extends from the end of the cap to provide a pushing portion for the end.

An inner tubular member 18 is connected to the front end of the housing through a connecting member 17, which is coaxial with the outer member 11. The interior of the inner member 18 is connected to the chamber 14*a* via a path 17*a* formed in the connecting member 17 for receiving a single lead rod supplied from the chamber 14*a*. Furthermore, the inner member 18 has a plurality of slits 18*a* extending in the axial direction from the front end to the central portion thereof to form a plurality of chucks 18*b*, which are biased outwardly by the resiliency of the member 18 to form a space through which the lead rod projects.

The guide means 12 includes a tubular member 19 having a generally troidal configuration and a tubular holding member 20 securely fixed within the top of the member 19. The holding member 20 is arranged coaxially with the inner member 18, so that the lead rod in the inner member 18 can project through the member 20, and provide a protruding portion for writing. The tubular member 19 has a cylindrical recess 19*a* provided for movably receiving the chucking portions 18*b* and a ring 21. The front end of the recess 19*a* forms a stopper for restricting the forward movement of the ring 21 but allows for forward movement of the chucking portions 18*b*. A friction ring 22 provides the proper frictional engagement with the lead rod to control the axial movement of the lead rod.

In the cylindrical space defined by the inner tube 18, the outer tube 11 and the tubular member 19, there is enclosed a generally cylindrical or annular member 23 having a pair of flat surfaces 23*a* and 23*b* at both ends. The member 23 is movable relative to the outer and inner members 11 and 18. The movable member 23 is biased in the forward direction by a spring 25, which is placed between a washer 24 abutting the projection 11*a* and the first flat surface 23*a*. In the ordinary state, the member 23 is pressed ino engagement with an annular surface 19*c* formed at the rear end of the recess 19*a* via a washer 26. An additional spring 27 is placed between the second surface 23*b* and the front end of the connecting member 17, and acts to press the inner member 18 and the other members integral therewith backward against the movable member 23. The spring force from the spring 27 provides the chucking force to the chucks or chucking portions 18*b* by movement of the inner member 18 relative to the ring 21.

The piece place or rod used extends through the interior of the inner member from the top end of the holding member 20, and is chucked between the chucking portions 18*b*, which are pushed inwardly by the ring 21.

The forward movement of the lead rod, registered within the chuck 18, is accomplished by pushing the button 16 forward. The forward movement of the button 16 causes the holding means 13 to move in the same direction with the lead being chucked and the ring 21 frictionally coupled with the chucking portions 18*b*, until the front end contacts with the first stopper 19*b*. Accordingly, the lead rod is kept in the chucked condition and moves forward by overcoming the friction between the lead rod and the friction member 22. In the course of the forward movement, the ring 21 stops its forward movement upon contacting the first stopper 19*b*, while the inner member 18 continues to move forward. As the result, the chucking portions 18*b* are released from the chucking engagement with the ring 21 and moved outward due to their resiliency, thereby allowing continued movement of the lead rod in the axial direction.

After the push-button 16 is released from the pushing operation, the holding means 13 moves backward under urging of the spring 27. However, the lead rod is kept in position by friction between the lead rod and the friction member 22. The lead rod is again chucked, when the inner member 18 returns to its original position, where the chucking portions 18*b* are pressed inward by the ring 21, which is pushed forward against the chucking portions 18*b* by the washer 26. The position of each of the movable members is same as they were initially with the exception that the lead rod has been moved forward by one step length. Accordingly, one can move the lead rod by the requisite length by repeating the pushing and releasing operation. When the push-button 16 has been pushed continuously, the leads can be moved forward or backward, since they encounter only a slight friction.

When writing, a larger force is impressed on the outer member 11, in order to push it against the surface of the paper. A counter force thereto will act to push backward the lead rod and the holding means 13. Although the holding means 13 is held in a stable position, restricted by the washer 26 and the ring 21 contacting therewith, it is moved backward with compressing the spring 25, which pushes the chucking ring 21 through the movable member 23 and washer 26, when the lead is subjected to a force acting backward. After the large force is removed, the holding means 13 will return to its original position by the action of the spring 25.

As has been stated, in propelling the lead according to this invention, the lead rod and the holding means 13 will move backward, when subjected to a force acting to the outer member 11 in the direction toward the surface of a paper sheet. Accordingly, the lead rod does not receive a force greater than a predetermined value corresponding to the righting movement of the spring 25 thereby eliminating breaking of the lead rod. In addition, the backward movement of the lead rod, i.e., the decrease in the projecting length of the lead rod from the top of the holding member 20, provides a good writing feel.

FIGS. 2 to 6 illustrate additional embodiments showing modified automatic pencils, according to this invention, in which same or similar parts, as in FIG. 1, are denoted by the same reference numerals.

Figure 2:
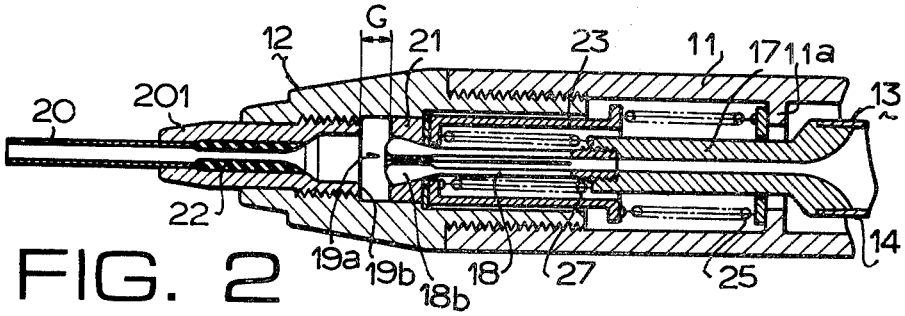

In the embodiment of FIG. 2, the holding member 20 is connected to the tubular member 19 through an adjusting member 201, which is supported by the member 19, so as to be movable in the axial direction by rotation thereof. Therefore, there is a gap G between the inner end of the member 201 forming the stopper 19*b* and the front end of the movable member 23. The adjustment of the gap G allows one to adjust the length of the stroke of the ring 21, which substantially corresponds to the one step length of the lead.

Figure 3:
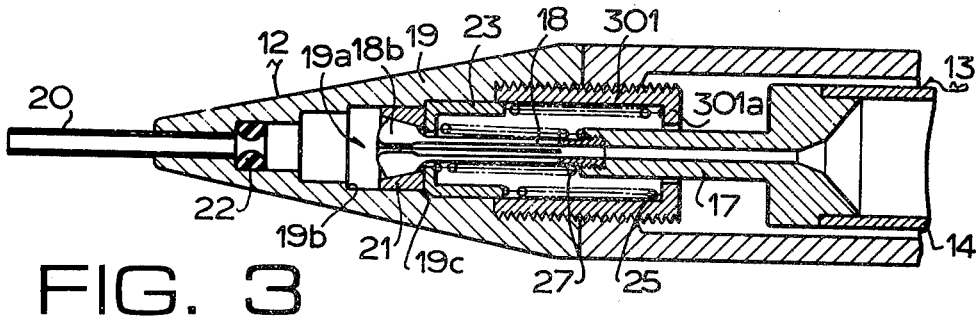

In FIG. 3, a tubular member 301 is used to connect the member 19 to the outer tube 11. The rear end wall 301*a* forms a receptacle for the rear end of the first spring 25 in lieu of the projection 11*a*.

Figure 4:
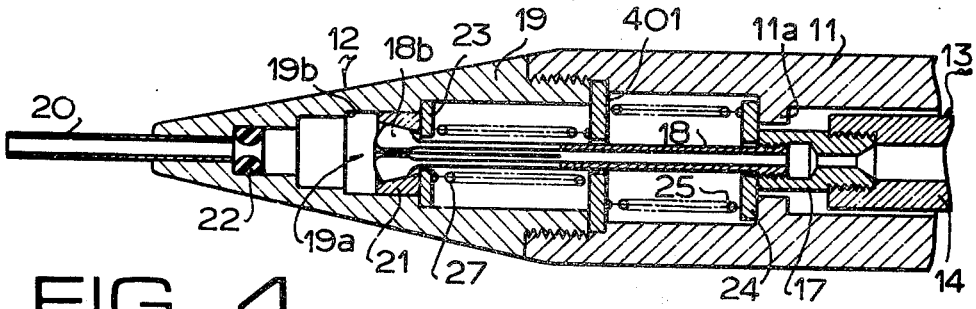

The embodiment, shown in FIG. 4, includes a receiving ring 401 held in position between the outer tube 11 and tubular member 19. The first spring 25 is placed between the ring 401 and washer 24, while the second spring 27 is placed between the ring 401 and movable member 23.

Figure 5:
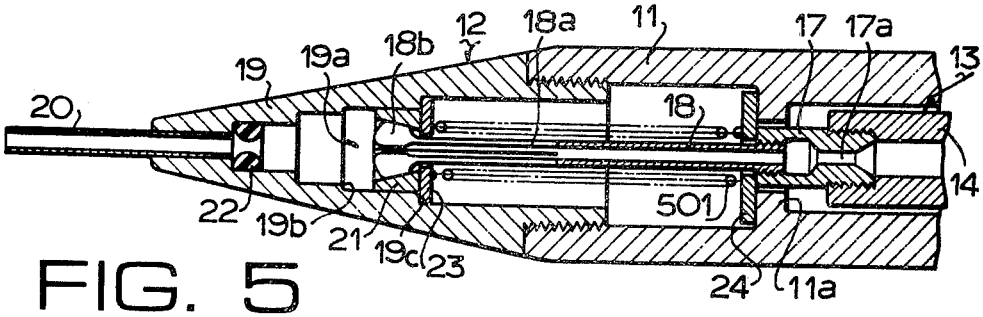

In the modification of FIG. 5, the receiving ring 401 is omitted and a single spring 501 is placed between the washer 26 and movable member 23 for biasing the holding means backward and the movable member 23 forward.

It will be clearly understood that the modifications, illustrated in FIGS. 2 to 5, ensure the backward movement of the lead, when subjected to a force larger than the predetermined value.

Figure 6:
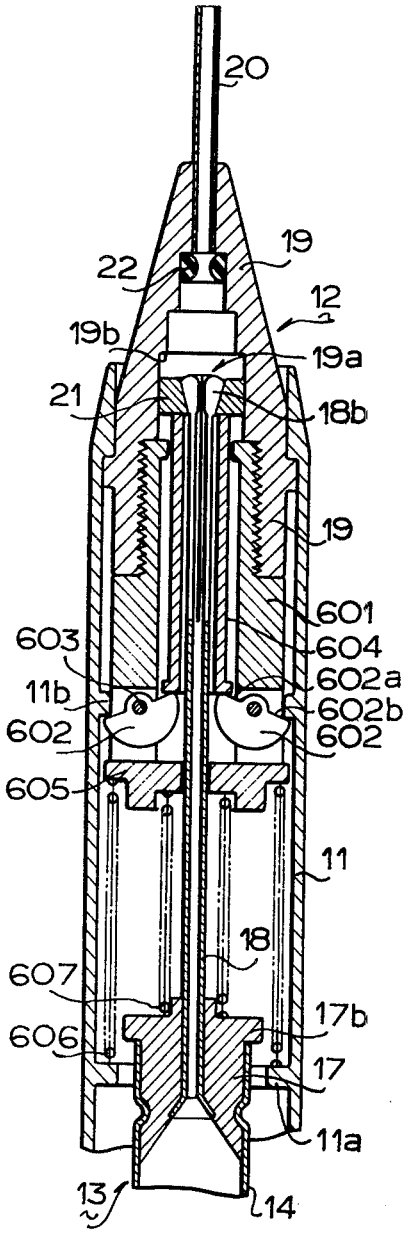

FIG. 6 illustrates a further embodiment of this invention, wherein the lead is capable of being moved forward by knocking the push-button, as well as by pushing the outer tube forward and then moving the tube back. In this embodiment, the basic arrangement and construction are substantially same as the previous embodiments, with the exception that the guide means 12 is movable relative to the outer tube 11 within a predetermined range. The movable guide means comprises a cylindrical member 601 connected to the tubular member 19 and a pair of cams 602 rotatably supported at the rear end of the member 601 by means of a shaft 603. Each cam 602 has two cam surfaces 602*a* and 602*b*. The former cam surface 602*a* engages with the end of a sleeve 604 described below and the latter 602*b* with a stopper 11*b* formed at the inner surface of the outer tube 11. An annular member 605 is provided for receiving one end of spring 606, the other end of which contacts the projection 11*a*. Another spring 607 having a spring of lesser stiffness than the spring 606 is placed between the annular member 605 and the front end of the connecting member 17 which, in this embodiment, has a flange 17*b* for restricting one end of the stroke of the holding means 13.

When no external force is exerted, each cam 602 tends to rotate in a direction, so that the inner cam face 602*a* moves forward, so as to push the ring 21 through a sleeve 608, which is disposed coaxially to the inner tube 18 and movable relative thereto, because the tubular member 19 is urged forward by the action of the springs 606 and 607. On the other hand, the inner tube 18 is urged backward, together with the connecting member 17 by the springs 607, so that the chucking portions 18*b* are pressed inward. The difference in spring force, between the first and second springs 606 and 607, is selected so that the ring 21 is positioned near the central portion of the movable range thereof.

If the outer tube 11 is pressed forward, the lead will move backward, still being chucked by the chucking portions 18*b* with the inner tube 18 and ring 21 against the spring force of the spring 606, until the flange 17*b* comes into contact with the projection 11*a*.

After the flange 17*b* contacts the projection 11*a*, the inner tube 18 is pushed forward by the outer tube 11, so that the chucking portions 18*b* are released from restriction by the ring 21 and allow the lead rod to move backward. Therefore, the guide means 12 will move backward with the lead rod, after the free end of the holding member 20 contacts the paper sheet. At the last stage of the movement of the holding member 20, the stopper 19*b* pushes the ring 21 backward to release the chucking portions 18*b*. When the outer tube 11 is disengaged from the paper sheet, the inner tube first moves backward to the ring 21, which abuts the front end of the member 601 to chuck the lead rod and then, during the forward movement of the guide means 12 relative to the outer tube 11, the cams 602 rotate so as to push the sleeve 604 forward. This results in the forward movement of the ring 21 with the inner tube 18, now secured thereto, and with the chucked lead rod having the desired predetermined length.

Of course, it is also possible to move the lead rod by knocking the push-button 16 (not shown in FIG. 6).

What is claimed is:

1. An automatic pencil comprising:
a. an outer tube to be held by the user;
b. a holding means having an inner tube coaxially inserted in said outer tube and movable in the axial direction relative to said outer tube;
c. said inner tube having a plurality of chucking portions to chuck a lead piece disposed therebetween;
d. a guide means having a tubular member connected to said outer tube for guiding the lead piece chucked by said chucking portions and defining a space;
e. a ring having a bore through which said chucking portions project and disposed in said space in a manner to be movable in the axial direction;
f. a movable member provided for pushing said ring forward to cause said chucking portions to chuck the lead piece;
g. means for urging said movable member forward and said inner tube backward; and
h. a push-button for pushing said holding means forward.

2. An automatic pencil as defined in claim 1 wherein said urging means comprises a first spring for urging said inner tube forward and a second spring for urging said holding means backwards.

3. An automatic pencil as defined in claim 1 wherein said holding means includes a housing connected to said inner tube, a cap member having a push-button and a spring member having a portion to secure said cap member on said housing and another portion extending from said cap member.

4. An automatic member pencil as defined in claim 1 wherein said guide means includes an adjusting member for adjusting the movable range of said ring.

5. An automatic pencil as defined in claim 4 wherein said adjusting member comprises a member movably connected to said tubular member and having an inner end which defines a stopper for said ring.

6. An automatic pencil comprising:
a. an outer tube to be held by the user;
b. a holding means having an inner tube coaxially inserted in said outer tube and movable in the axial direction relative to said outer tube;
c. said inner tube having a plurality of chucking portions to chuck a lead piece disposed therebetween;
d. a guide means having a tubular member connected to said outer tube for guiding the lead piece chucked by said chucking portions and defining a space;
e. a ring having a bore through which said chucking portions project and being disposed in said space in a manner to be movable in the axial direction;
f. means for causing said ring to be pushed forward when the guide means is moved forward and to be released from the pushing action when said inner tube is moved forward thereby allowing the backward movement of the lead piece; and
g. means for urging said guide means forward relative to said outer tube and said inner tube backward to said guide means.

* * * * *

UNITED STATES PATENT AND TRADEMARK OFFICE

CERTIFICATE OF CORRECTION

PATENT NO. : 3,947,133

DATED : March 30, 1976

INVENTOR(S) : Hidehira Kageyama et al.

It is certified that error appears in the above-identified patent and that said Letters Patent are hereby corrected as shown below:

Claim 4, line 1, delete "member"

Signed and Sealed this

*eighth* Day of *June 1976*

[SEAL]

*Attest:*

RUTH C. MASON
*Attesting Officer*

C. MARSHALL DANN
*Commissioner of Patents and Trademarks*